United States Patent [19]

Sun et al.

[11] 4,324,360

[45] Apr. 13, 1982

[54] ELEVATOR GUIDE RAIL MOUNTING ARRANGEMENT

[75] Inventors: Lu Sun; Janis J. Cilderman, both of Simsbury, Conn.

[73] Assignee: Otis Elevator Company, Farmington, Conn.

[21] Appl. No.: 229,914

[22] Filed: Jan. 30, 1981

Related U.S. Application Data

[63] Continuation of Ser. No. 19,199, Mar. 9, 1979, abandoned.

[51] Int. Cl.[3] ..... E01B 9/00

[52] U.S. Cl. ..... 238/349; 187/95

[58] Field of Search ..... 187/95, 9 E, 9 R; 238/349, 340, 282

[56] References Cited

U.S. PATENT DOCUMENTS 3,362,639 1/1968 Van Sant ..... 238/349

3,982,692 9/1976 Feyner et al. ..... 187/95

*Primary Examiner*—Robert J. Spar

*Assistant Examiner*—Kenneth Noland

*Attorney, Agent, or Firm*—Robert E. Greenstien

[57] ABSTRACT

A clip is bolted to the wall at points along the rail to hold the rail on the wall. Each clip includes a rigid retainer and a curved springy spacer. The clip is bolted to the wall to force the spacer against the rail, to force the rail against the wall. The spacer is slightly flattened to hold the rail in place, but allows the rail to slide in the retainer, along the wall, as the wall settles, thus preventing compression forces in the rail between the clips.

2 Claims, 5 Drawing Figures

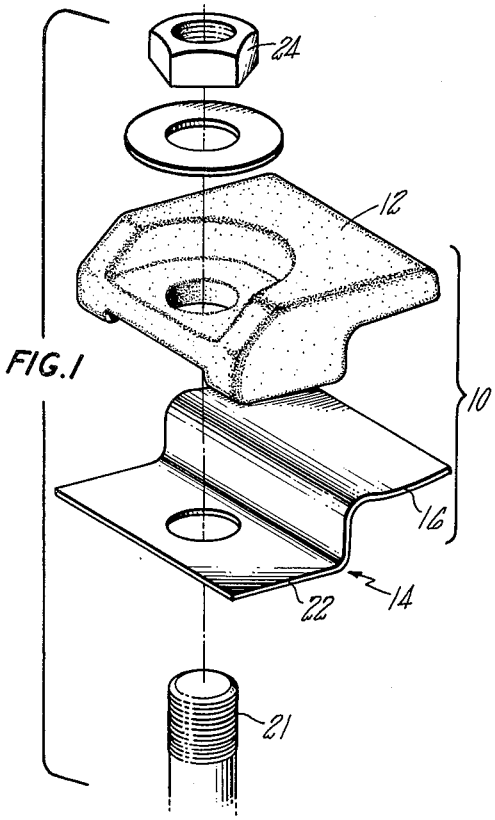
FIG. 1
FIG. 2
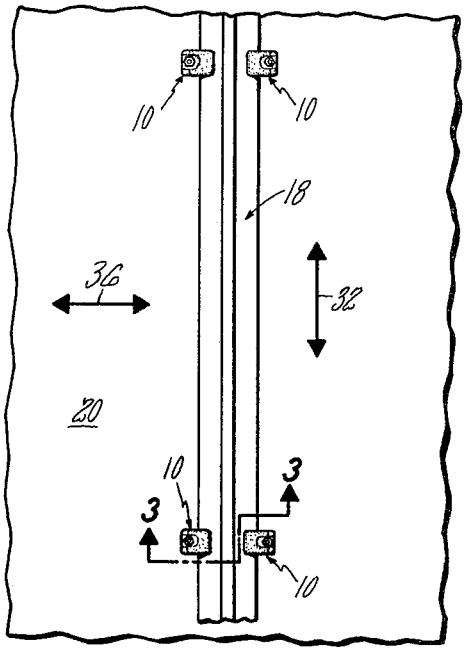
FIG. 3
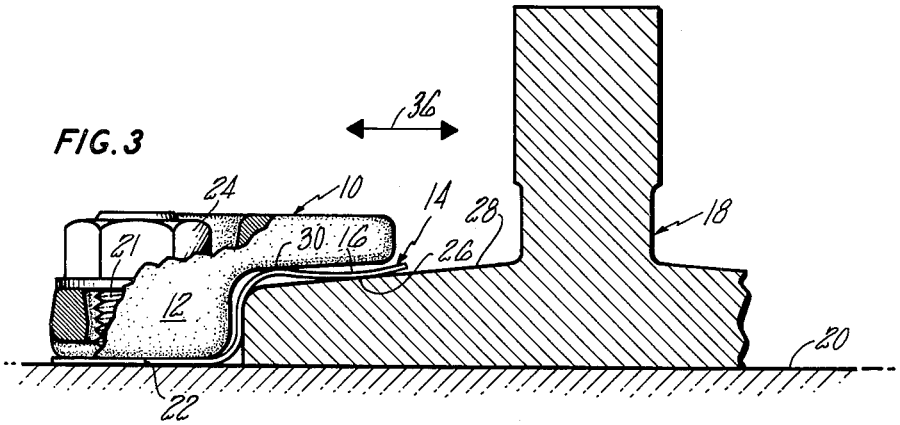
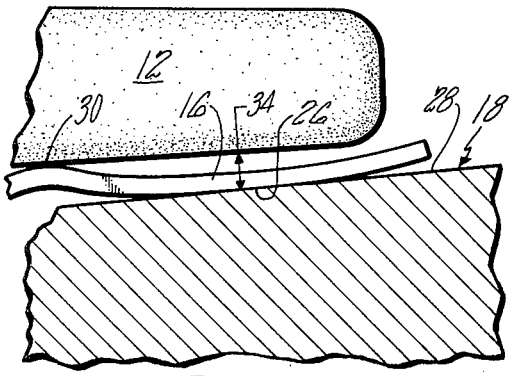
FIG. 4 TIGHT
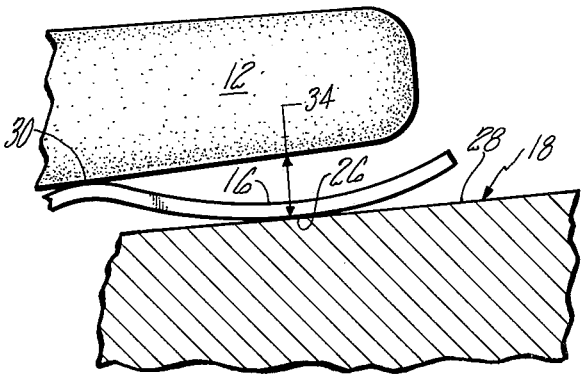
FIG. 5 LOOSE

ELEVATOR GUIDE RAIL MOUNTING ARRANGEMENT

This is a continuation of application Ser. No. 019,199 filed Mar. 9, 1979, now abandoned.

BACKGROUND OF THE INVENTION

This invention relates to arrangements for mounting the guide rails commonly utilized in elevator installations.

To provide a smooth, stable, straight ride as it ascends and decends in the elevator shaft, the typical elevator car rides on wheels which roll on rails that are rigidly mounted on the walls of the shaft. A new building not uncommonly settles following its construction, and as that happens the elevator shaft also settles. Frequently the shaft shrinks slightly, as a result, which can produce substantial compression forces in the rail between the points at which it is fixed to the wall because as the wall shrinks these points are forced closer together, albeit slightly. As a result of these forces, bends and curves can develop in the rail. They can produce a wavy or uneven path for the car and, therefore, an unpleasant ride. The only way to remedy this problem is to relieve or relax the forces by loosening the rails, then retightening them.

The rails are installed in sections, particularly short ones, which are less prone to these effects, principally because the compression forces on each section is smaller than it would be in a large section. A space is provided between sections for accommodating some "inter-section" movement as the shaft settles: to minimize the "intrarail" compression forces, by preventing the rails from touching. That further inhibits the chance that bends and curves will develop, because the compression forces are broken up between rails. The ends of the sections often are tongue & groove to facilitate rail installation and also to prevent major section to section misalignment to avoid sharp changes in rail direction between sections as they shift slightly relative to each other as the shaft settles. Each section is rigidly or nonmovably mounted to the wall, and thus as the shaft settles, the rails actually move closer to each other, but there is no movement between an individual rail and its support points on the walls, however. The potential for bends and curves nevertheless still exists in these sections, although at a reduced level.

Multisection rails are expensive to fabricate, and their installation can also be expensive, mainly because the sections have to be aligned and plumbed within the shaft. The cost obviously increases as the number of sections increases, since that requires more work during installation. In some instances, moreover, after installation realignment of the sections is needed; there cost also increases with the number of sections, for the same reason. In contrast, rails composed of larger sections obviously are less expensive to fabricate, easier to install and maintain and less prone to misalignment. Furthermore, improved ride quality can result from longer rails, mainly because there is less intersection space, therefore less bumps and jolts. A problem with longer rails, however, is that they are more prone to developing bends and curves.

SUMMARY OF THE INVENTION

Objects of the invention include mounting rail sections on the shaft walls and minimizing their susceptibility to develop curves and bends as the shaft shrinks or settles for reducing the costs associated with rail fabrication, installation and maintenance.

According to the present invention each rail section is "resiliently" fastened to the wall, so that it can move or shift slightly on its support points, relative to the wall, to prevent compression forces above an acceptable level along the rail, between those support points. To accomplish this, a rail clip apparatus is provided which includes a retainer that is tightly fixed to the wall and a springy or resilient spacer which is forced (tensioned) against the rail by the retainer to hold the rail "resiliently" on the wall. The spacer is flexible: it can expand and contract, which allows the rail to slide in the retainer to move relative to the wall. The clips are positioned at prescribed distances apart along the wall in the vertical direction. As the wall shrinks, the clips move closer, essentially by sliding along the rail, which prevents the buildup of compression forces in the rail between the clips.

Other objects, benefits and features of the invention will be apparent to one skilled in the art from the following detailed description and claims and the accompanying drawing, wherein:

DESCRIPTION OF THE DRAWING

FIG. 1 is an exploded perspective view of a clip apparatus according to the present invention for holding guide rails in place;

FIG. 2 is an elevation of an elevator shaft wall, illustrating a typical rail section fastened to a shaft wall by utilizing the clip apparatus of the present invention;

FIG. 3 is an elevation of the guide rail and the clip as seen along the line 3—3 in FIG. 2;

FIG. 4 is a magnification of a portion of the clip, illustrating the tensioned separator for holding the rail in place;

FIG. 5 is a magnification of a portion of the clip, illustrating the relaxed or untensioned separator.

DETAILED DESCRIPTION

In FIG. 1 an embodiment of the invention is shown as a clip apparatus 10 that includes a rigid retainer 12 and a spring spacer 14, which includes a generally curved or bent section 16. The spacer is generally congruent with the inner contour of the retainer for it to easily conform therewith to hold the rail in place as shown in FIG. 2.

In FIGS. 2 and 3 a typical guide rail section 18 is resiliently held in place on a wall 20 by means of several clips 10, positioned in pairs, as shown. A threaded stud or bolt 21 is implanted into the wall and passes through holes in the base 22 of the spacer and the base 23 of the retainer. A nut 24 is threaded and tightened onto the stud to hold the rail in place by forcing the retainer against the curved section of the separator to force a portion 26 thereof against the base 28 of the rail.

A portion of FIG. 2 magnified significantly in FIG. 3 illustrates the change brought about in the shape of the spacer, specifically in the curved section 16, as the retainer is bolten down (the nut is tightened); that change being instrumental to the present invention. When the nut is "tight" the retainer is pushed against the spacer along an interface 30 which tensions the curved section slightly, as it is urged toward the base of the rail, "sandwiching" it in the space 34 therebetween. This change can be seen by comparison to FIG. 4, wherein the spacer is untensioned or relaxed, not sandwiched, (its condition when the nut is "loose"). In this way, a rail hold-down force is transmitted from the retainer to the base through the spacer, as the nut is tightened, by which the rail is forced against the wall and held thereon.

The curved section is not completely flattened, however, but can expand and contract (flex) to accommodate rail movement on the wall, up and down (arrow 32)—even though the retainer 12 remains completely stationary under such circumstances. If the retainer were to be directly fastened to the rail (as in the prior art), the rail could not slide in this manner, at least not without being somewhat loose on the base, which clearly would cause the rail to be loose on the wall. Moreover, due to variations in the base 18, specifically in its surface smoothness and thickness, a retainer along pressing on the base would have unpredictable friction characteristics mainly because it is not resilient and, therefore, is unable to compensate for (follow) such variations and hold the rail down with sufficient force at the same time. A retainer alone, obviously, is simply a hold or no-hold clip.

The utilization of the springy or resilient spacer 16 provides a noticeably dynamic hold-down force in as much as it can flex (flatten or expand) within the space 34 to compensate for any surface imperfections and abnormalities, and thereby permit the rail to slide between support points on the wall, comparatively freely, but still under sufficient force so that the rail is held securely against the wall. Horizontal restraint (arrow 34) is provided by the retainer, as shown in FIG. 4, which aids in maintaining alignment between rail sections. The spacer thus provides for movement of the rail relative to the wall without any looseness; therfore, it is not a hold or no-hold clip.

In the typical elevator installation, the clips 10 are fastened to opposite sides of the rail, as depicted, along the shaft at predetermined distances apart. Considering the foregoing, if the wall shrinks slightly the clip pairs move towards each other by sliding on the rail; thus permitting relative motion between the rail and the wall and alleviating any compression forces that might otherwise be established in the rail between the pairs, were they not permitted to move in this fashion.

An obvious feature of the clip is that it is simple to install. Installation involves nothing more than securely bolting the retainer down tightly in the wall. Specific torque levels are not necessary in as much as a deliberate special relationship is maintained between the base and the retainer to allow for moderate sandwiching of the spacer. Hence, to install the clip the nut only has to be tightened to the point where it securely holds the retainer in place on the wall and simultaneously flattens the curved section 16 enough to apply sufficient hold-down force on the rail base to clamp the rail on the wall.

The clip provides an important safety feature, as well, in that the retainer prevents any extreme rail movement away from the wall. For that reason the retainer is constructed preferably of thick forged steel; not unlike the construction of previous prior art clips of the type directly bolted to the rail. However, in as much as the spacer is deliberately intended to apply resilient force to the rail and bend or flex in the aforementioned manner, it is constructed of spring steel, with a thickness of 18 to 19 gauge, for example. The specific shape (curvature) of the curved section 16 is not critical; the only criteria being that it fill the intended space between the retainer and base and be compressed somewhat, but not fully, as shown in FIG. 4, to accommodate the relative rail movement as the wall shrinks. Thus, other spacer configurations may be used: for example, those having multiple curves, split curves or wavy, ripple-like curves.

While the foregoing is a detailed description of the preferred embodiment of the present invention, there may be suggested modifications and variations which can be made thereto by one skilled in the art without departing from the true scope and spirit of the invention as set forth in the following claims.

We claim:

1. An arrangement for mounting rails on a wall to alleviate compression forces in the rails associated with wall dimension changes, comprising:

a plurality of rail clip apparatus attached at spaced apart points on the wall for exerting a hold-down force on a rail surface for forcing the rail against the wall and adapted to slide simultaneously on the rail as the distance between the attachment points change, the apparatus including a spacer for applying hold-down force to the rail surface and a retainer which holds the spacer on the wall, characterized in that:

the retainer is rigid and L-shaped, having a main body section and an arm-like section, said arm-like section for extending over a portion of the rail surface in a spaced relationship with the rail surface so as to restrain rail movement within a prescribed distance from said wall, and said main body section for restricting movement of the rail along the wall, when the apparatus is attached to the wall, the spacer is constructed of springy steel and is Z-shaped and includes a concave portion, the concavity of which faces said arm-like section and which is forced against the rail surface by said arm-like section, which forces one end of said concave portion towards the wall when the retainer and spacer are attached thereto, said spacer including an additional portion which is squeezed between said main body section and the wall when the apparatus is attached thereto, and the balance of said concave portion, beginning at said one end, being free to move within the space between said arm-like section and the rail surface, whereby said balance of said concave portion applies resilient hold-down force to the rail for holding it resiliently in place between said arm-like section and the wall, and said arm-like section limits the travel of said concave portion and the rail away from the wall.

2. A rail clip apparatus for attachment at spaced apart points on a wall for holding a rail in position on the wall, the apparatus including a spacer for applying hold-down force to the rail surface and a retainer which holds the spacer on the wall, characterized in that:

the retainer is rigid and L-shaped, having a main body section and an arm-like section, said arm-like section for extending over a portion of the rail surface in a spaced relationship with the rail surface so as to restrain rail movement within a prescribed distance from said wall, and said main body section for restricting movement of the rail along the wall, when the apparatus is attached to the wall, the spacer is constructed of springy steel and is Z-shaped and includes a concave portion, the concavity of which faces said arm-like section and which is forced against the rail surface by said arm-like section, which forces one end of said concave portion towards the wall when the retainer and spacer are attached thereto, said spacer including an additional portion which is squeezed between said main body section and the wall when the apparatus is attached thereto, and the balance of said concave portion, beginning at said one end, being free to move within the space between said arm-like section and the rail surface, whereby said balance of said concave portion applies resilient hold-down force to the rail for holding it resiliently in place against the wall while permitting it to move within the space between said arm-like section and the wall, and said arm-like section limits the travel of said concave portion and the rail away from the wall.

* * * * *